US006188997B1

(12) United States Patent
Ratzenberger, Jr. et al.

(10) Patent No.: US 6,188,997 B1
(45) Date of Patent: Feb. 13, 2001

(54) POSTAGE METERING SYSTEM HAVING CURRENCY SYNCHRONIZATION

(75) Inventors: Roger J. Ratzenberger, Jr., Milford; Brad L. Davies, Trumbull; Kathleen M. English, Rocky Hill; Dale A. French, Clinton; Wesley A. Kirschner, Hamden; Sandra J. Peterson, Norwalk; Ian A. Siveyer, Monroe, all of CT (US)

(73) Assignee: Pitney Bowes Inc., Stamford, CO (US)

( * ) Notice: Under 35 U.S.C. 154(b), the term of this patent shall be extended for 0 days.

(21) Appl. No.: 09/294,607

(22) Filed: Apr. 19, 1999

(51) Int. Cl.[7] ..... G07B 17/02
(52) U.S. Cl. ..... 705/410; 705/408
(58) Field of Search ..... 705/400, 401, 705/408, 410

(56) References Cited

U.S. PATENT DOCUMENTS

| | | | | |
|---|---|---|---|---|
| 4,757,537 | * | 7/1988 | Edelmann et al. | 380/51 |
| 4,831,555 | * | 5/1989 | Sansone et al. | 358/1.14 |
| 4,858,138 | * | 8/1989 | Talmadge | 364/464.02 |
| 5,688,056 | * | 11/1997 | Peyret | 400/61 |
| 5,742,932 | | 4/1998 | Levitsky | 705/410 |
| 5,799,290 | * | 8/1998 | Dolan et al. | 705/410 |
| 5,917,925 | * | 6/1999 | Moore | 381/101 |
| 5,960,418 | * | 9/1999 | Kelly et al. | 705/408 |
| 6,029,137 | * | 2/2000 | Cordery et al. | 705/1 |
| 6,064,989 | * | 5/2000 | Cordery et al. | 705/50 |

FOREIGN PATENT DOCUMENTS

| | | | |
|---|---|---|---|
| 0 493 948 B1 | | 12/1991 | (EP) . |
| 0811955 A2 | * | 12/1997 | (EP) . |

OTHER PUBLICATIONS

Trefgarne: "City: City impervious to the hype and the glory George Trefgarne reports preparations for Monday's trading in the euro"; Jan. 2, 1999, Daily Telegraph.*

"Sterling disappears from Royal Mail's stamp for Europe" Dec. 13, 1998 Sunday Times (United Kingdom).*

* cited by examiner

*Primary Examiner*—Edward R. Cosimano
(74) *Attorney, Agent, or Firm*—Angelo N. Chaclas; Michael E. Melton

(57) ABSTRACT

A postage metering system includes a printer and a postage meter. The postage meter includes a micro controller for generating token data for use in printing a postal indicia where the token data includes an indicator of a token currency type. The printer is in communication with the postage meter and includes a micro controller, a memory and a print mechanism for printing the postal indicia on a mailpiece. The printer memory has stored therein indicia graphic data including an indicator of an indicia graphic currency type. The printer micro controller receives the token data from the postage meter and compares the token data indicator of the token currency type with the indicia graphic data indicator of the indicia graphic currency type prior to printing the postal indicia.

15 Claims, 5 Drawing Sheets

POSTAGE METERING SYSTEM HAVING CURRENCY SYNCHRONIZATION

CROSS REFERENCE TO RELATED APPLICATIONS

This application is related to the following concurrently filed copending U.S. Patent Applications: application co./no. 09/294,607 filed Apr. 19, 1999 entitled POSTAGE METERING SYSTEM HAVING SEPARABLE MODULES WITH MULTIPLE CURRENCY CAPABILITY AND SYNCHRONIZATION (E-721) and application co./no. 09/294,604 filed Apr. 19, 1999 entitled POSTAGE METERING SYSTEM HAVING CURRENCY COMPATIBILITY SECURITY FEATURE (E-854), the disclosures of which are specifically incorporated herein by reference.

FIELD OF THE INVENTION

This invention relates to value dispensing systems. More particularly, this invention is directed to preventing tampering with a postage metering system including a postage meter for securely storing postal accounting information and a printer for printing a postal indicia.

BACKGROUND OF THE INVENTION

One example of a value dispensing system is a postage metering system including an electronic postage meter and a printer for printing a postal indicia on an envelope or other mailpiece. Recent efforts have concentrated on removing the printer from being an integral part of the postage meter. Also, the postage meter is generally detachable from the printer so that any number of postage meters may be operatively coupled with the printer.

Electronic postage meters for dispensing postage and accounting for the amount of postage used are well known in the art. The postage metering system supplies proof of the postage dispensed by printing a postal indicia which indicates the value of the postage on an envelope or the like. The typical postage meter stores accounting information concerning its usage in a variety of registers. In a pre-payment type of postage meter, such as those employed in the United States, an ascending register tracks the total amount of postage dispensed by the meter over its lifetime. That is, the ascending register is incremented by the amount of postage dispensed after each transaction. A descending register tracks the amount of postage available for use. Thus, the descending register is decremented by the amount of postage dispensed after each transaction. When the descending register has been decremented to some value insufficient for dispensing postage, then the postage meter inhibits further printing of indicia until the descending register is resupplied with funds. In a post-payment type of postage meter such as those employed in France, the ascending register may be retained as described above while the descending register is eliminated or set to an extremely high value.

Generally, the postage meter communicates data necessary for printing a postal indicia to the printer over suitable communication lines, such as: a bus, data link, or the like. During this transfer, the data may be susceptible to interception, capture and analysis. If this occurs, then the data may be retransmitted at a later time back to the printer in an attempt to fool the printer into believing that it is communicating with a valid postage meter. If successful, the result would be a fraudulent postage indicia printed on a mailpiece without the postage meter accounting for the value of the postage indicia.

It is known to employ secret cryptographic keys in postage metering systems to prevent such fraudulent practices. This is accomplished by having the postage meter and the printer authenticate each other prior to any transfer of print data or printing taking place. One such system is described in U.S. patent application Ser. Co./No. 08/579,507, filed on Dec. 27, 1995, and entitled METHOD AND APPARATUS FOR SECURELY AUTHORIZING PERFORMANCE OF A FUNCTION IN A DISTRIBUTED SYSTEM SUCH AS A POSTAGE METER (E-476) and now issued as U.S. Pat. No. 5,799,290. Another such system is described in U.S. patent application Ser. Co./No. 08/864,929, filed on May 29, 1997, and entitled SYNCHRONIZATION OF CRYPTOGRAPHIC KEYS BETWEEN TWO MODULES OF A DISTRIBUTED SYSTEM (E-612). These types of mutual authentication systems help to ensure that the printer is being contacted by a valid postage meter and that the postage meter is in communication with a valid printer.

Once the postage meter and the printer have mutually authenticated each other, the exchange of print data may begin. A portion of the print data requires generation of a secure token in the postage meter. This token is printed within the postal indicia and is used by a postal authority to verify the integrity of the postal indicia. Generally, the token is an encrypted representation of the postal information contained within the postal indicia printed on the mailpiece. In this manner, the postal authority can read the postal information printed on the mailpiece and independently calculate a token for comparison purposes with the token printed on the mailpiece. In the alternative, the token on the mailpiece may be decrypted to derive the postal information that is anticipated to be printed on the mailpiece. Examples of such techniques are described in U.S. Pat. Nos. 4,831,555 and 4,757,537.

To expedite print data transfer from the postage meter to the printer, the postal indicia may be partitioned into fixed data (graphics) and variable data (date, postage amount, piece count, serial number, etc.). Generally, the fixed data does not change from postal indicia to postal indicia while the variable data may change from postal indicia to postal indicia. To save data transmission time, the fixed data may be previously stored at the printer while the variable data is generated by the postage meter. To print a complete postal indicia, the variable data is transmitted to the printer and then merged with the fixed data at the printer to produce the print data signals necessary to drive the printer.

Additionally, to remain competitive in a global marketplace, it is important to design and build postage metering systems that may be efficiently deployed where consumer demand exists. This means that postage metering systems must be adapted for use depending upon the local currency (US $, CAN $, UK £, F-Franc, D-mark, S-Franc, Lira, Yen, Euro, etc.). Therefore, it is desirable to have the flexibility of moving postage metering systems from country to country as needed. Generally, the design of the postal indicia is subject to approval and/or specification by the postal authority. As a result, although the fixed data may change from country to country, the fixed data typically remains uniform in a given country for each postage metering system once a format has been established in the given country.

Although mutual authentication and token verification contribute significantly to the security of the postage metering system, potential attack points still exist. For example, it may be possible to manipulate the fixed data portion of a postal indicia so that postage is accounted for in a first currency and printed in a configuration that reflects a second currency. Depending upon the exchange rate between the two currencies, significant advantages could be gained by the successful attacker.

For example, if the attacker were successful in obtaining a postage metering system from Japan having accounting registers indicative of values in Yen and replacing the fixed print data corresponding to Japan with fixed print data corresponding to the United States, then the attacker could produce fraudulent postage in the United States using an authentic postage metering system that may survive scrutiny by the United States Postal Service (USPS). With an exchange rate of one United States dollar (1 US $) approximately equal to one hundred twenty Yen (120 Y), the attacker would realize a substantial return on investment because a resulting postal indicia appearing on its face to indicate a value of one United States dollar (1 US $) would be accounted for as one Yen (1 Y).

As a secondary consideration, interchangeability of components, such as using the same postage meter with a plurality of different printers or using a plurality of different postage meters with the same printer is desirable. For example, a mailer located near the boarder of two countries may have need to post mail in both countries. So as to avoid redundancy and expense, the mailer would not want to operate two metering systems.

Therefore, there is a need for a postage metering system including a postage meter and a printer in communication with but physically separate from the postage meter that provides for efficiency of operation and synchronization of the accounting currency and the print data currency.

SUMMARY OF THE INVENTION

Accordingly, it is an object of the present invention to provide a postage metering system with improved security that substantially overcomes the problems associated with the prior art by protecting the integrity of the currency/postal indicia image association while allowing for the interchangeability of postage meters and printers.

In accomplishing this and other objects there is provided a postage metering system including a printer and a postage meter. The postage meter includes a micro controller for generating token data for use in printing a postal indicia where the token data includes an indicator of a token currency type. The printer is in communication with the postage meter and includes a micro controller, a memory and a print mechanism for printing the postal indicia on a mailpiece. The printer memory has stored therein indicia graphic data including an indicator of an indicia graphic currency type. The printer micro controller receives the token data from the postage meter and compares the token data indicator of the token currency type with the indicia graphic data indicator of the indicia graphic currency type prior to printing the postal indicia.

In accomplishing this and other objects there is provided a method of operating a postage metering system and a method of manufacturing a postage metering system that are generally analogous to the summary provided above.

Therefore, it should now be apparent that the invention substantially achieves the objects and advantages discussed above. Additional objects and advantages of the invention will be set forth in the description that follows, and in part will be obvious from the description, or may be learned by practice of the invention. Moreover, the objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown through out the drawings, like reference numerals designate like or corresponding parts.

DETAILED DESCRIPTION OF THE PREFERRED EMBODIMENTS

Figure 1:
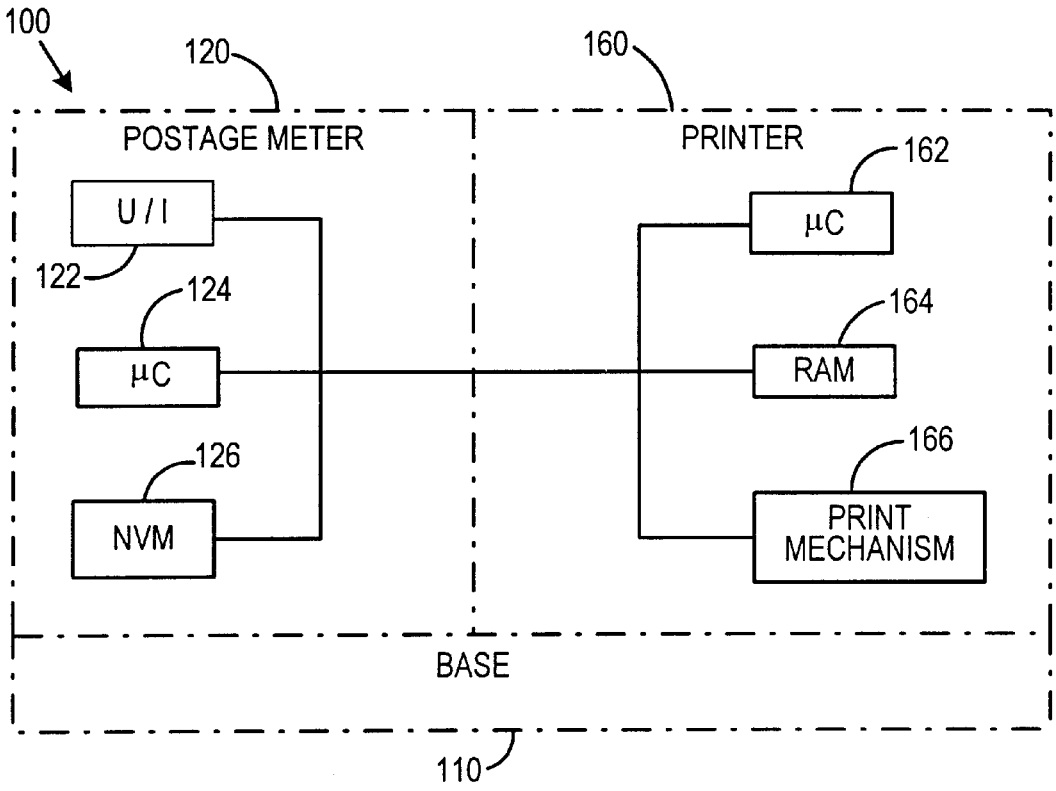
FIG. 1 is a schematic representation of a postage metering system including a base, a postage meter and a printer in accordance with the present invention.

Referring to FIG. 1, a postage metering system 100 in accordance with the present invention is shown. The postage metering system 100 includes a mailing machine base 110, a postage meter 120 and a printer 160.

The mailing machine base 110 includes a variety of different modules (not shown) where each module performs a different task on a mailpiece (not shown), such as: singulating (separating the mailpieces one at a time from a stack of mailpieces), weighing, moistening/sealing (wetting and closing the glued flap of an envelope) and transporting the mailpiece through the various modules. However, the exact configuration of each mailing machine base 110 is particular to the needs of the user. Since a detailed description of the mailing machine base 110 is not necessary for an understanding of the present invention, its description will be limited for the sake of clarity.

Generally, the meter 120 may exist in a variety of configurations (smart card, secure housing containing an accounting circuit board, or the like) and is detachably mounted to the mailing machine base 110 by any conventional structure (not shown). The postage meter 120 determines a token (not shown) for each mailpiece so that the postal indicia may be verified by the postal authority. Further detail of the token are provided below. The postage meter 120 includes a user interface 122, a micro controller 124 and a non-volatile memory (NVM) 126 all in operative communication with each other over suitable communication lines. The user interface 122 may include any conventional display/keyboard arrangement (not shown) for displaying messages to and receiving commands from an operator of the postage metering system 100. The micro controller 124 may be of any suitable combination of processors, hardware, firmware and software while the NVM 126 is preferably an EEPROM. The NVM 126 holds various accounting information (not shown) and postal information (not shown), such as: an ascending register, a descending register, a control sum register, a piece count register and a postal identification serial number. Additionally, the NVM 126 holds the indicia graphic data for the postal indicia in protected memory. Alternatively, separate NVMs may be employed for the accounting information and the graphic data. The indicia graphic data will be described in greater detail below.

The printer 160 may be detachably coupled to the mailing machine base 110 by any conventional structure (not shown) and includes a micro controller 162, a read access memory (RAM) 164 and a print mechanism 166 all in operative communication with each other over suitable communication lines. The RAM 164 stores the indicia graphic data that has been received from the postage meter 120. The micro controller 162 supplies print signals to the print mechanism 166 to print a postal indicia (not shown) on a mailpiece (not shown). Generally, the print mechanism 166 may be of any suitable design employing dot matrix or digital printing technology, such as: thermal transfer, thermal direct, ink jet, wire impact, electrophotographic or the like.

To provide for security of postal funds and to prevent fraud, the postage meter 120 and the printer 160 are provided with secret cryptographic keys which are necessary for mutual authentication to ensure that: (i) the postage meter 120 will only transmit postal indicia print information to a valid printer 160; and (ii) the printer 160 will only execute postal indicia print information received from a valid postage meter 120. Generally, a mutual authentication routine involves the encryption and decryption of secret messages transmitted between the postage meter 120 and the printer 160. An example of such a routine can be found in U.S. patent application Ser. Co./No. 08/864,929, filed on May 29, 1997, and entitled SYNCHRONIZATION OF CRYPTOGRAPHIC KEYS BETWEEN TWO MODULES OF A DISTRIBUTED SYSTEM, incorporated herein by reference. However, since the exact routine for mutual authentication is not necessary for an understanding of the present invention, no further description is necessary. Once mutual authentication is successful, the postage meter 120 is enabled to transmit postal indicia print information and the printer 160 is enabled to print a valid postal indicia.

Figure 2:
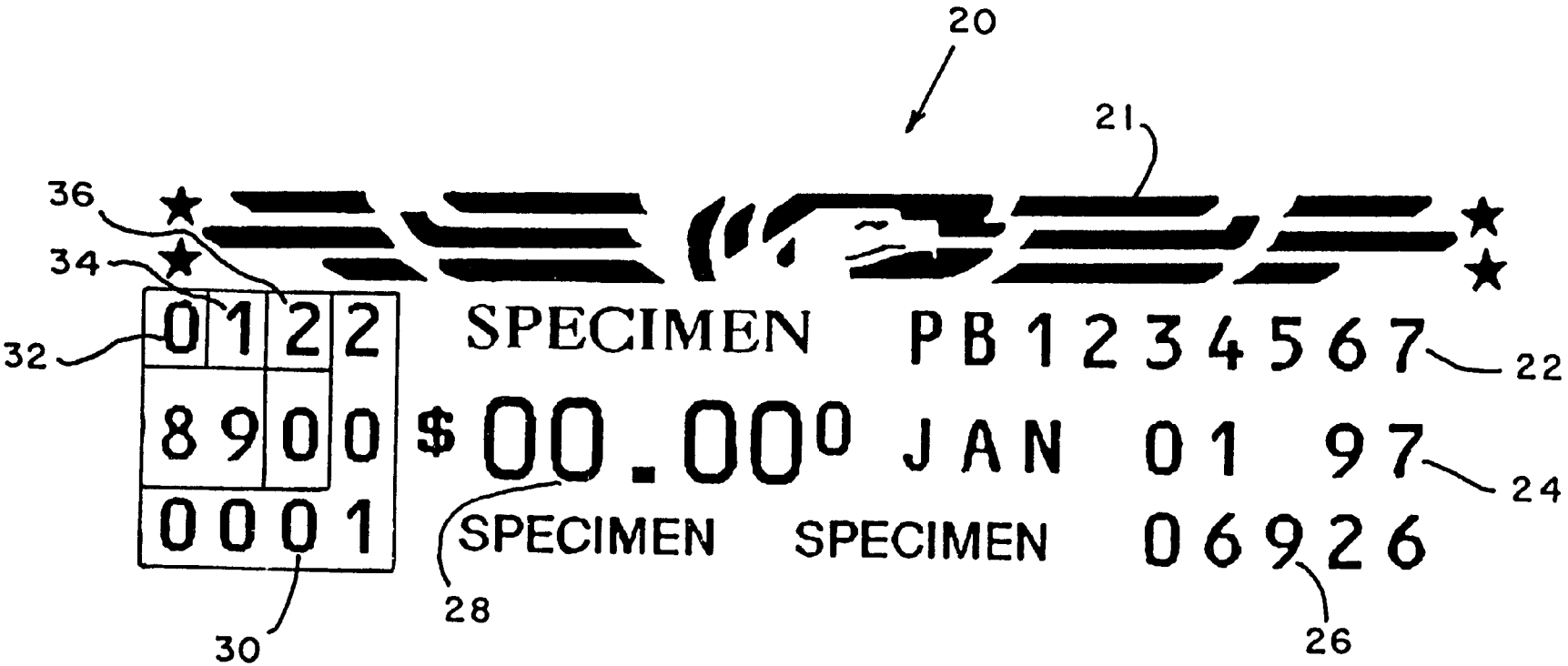
FIG. 2 is an example of a postal indicia that may be printed by the postage metering system of the present invention in a first country.

Referring to FIG. 2, an example of a postal indicia 20 that may be employed in the United States for example is shown. The postal indicia 20 includes both fixed data that does not change from postal indicia to postal indicia and variable data that may change from postal indicia to postal indicia. The fixed data includes a graphic design 21 (an eagle with stars), a meter serial number 22 uniquely identifying the postage meter 120 and a licensing post office ID (zip code) 26. The variable data includes a date 24 indicating when the postage was dispensed, a postal value 28 indicating an amount of postage, a piece count 30, a postage meter manufacturer ID 32, postage meter manufacturer verification data 34 and postal authority verification data 36. Using the data contained within the postal indicia 20, the postal authority can verify the authenticity of the postal indicia 20 using conventional techniques. Alternatively, the postal indicia 20 may only include a single token.

Generally, the graphic design 21 portion of the postal indicia 20 is unique for each country. However, this does not necessarily have to be true, but is dependent upon postal authority approval. Also, the variable data content may change from country to country.

Figure 3:
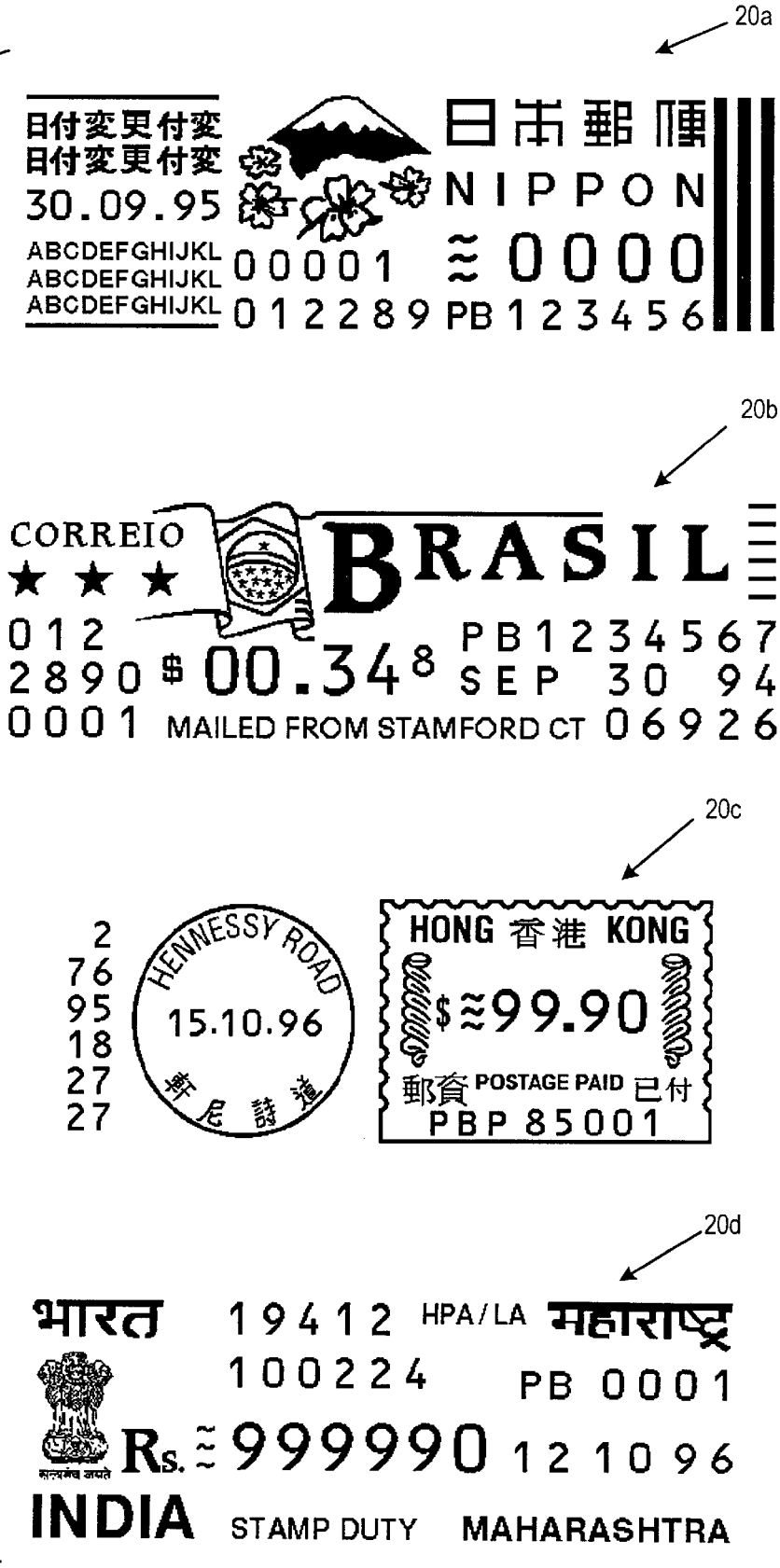
FIG. 3 is a sampling of a plurality of a postal indicia that may be printed by the postage metering system of the present invention in different countries.

Referring to FIG. 3, examples of a plurality of postal indicia 20*a*, 20*b*, 20*c* and 20*d* from a variety of countries are shown. The plurality of postal indicia 20*a*, 20*b*, 20*c* and 20*d* include both fixed and variable data as described above and are employed in Japan, Brazil, Hong Kong and India, respectively.

Figure 4:
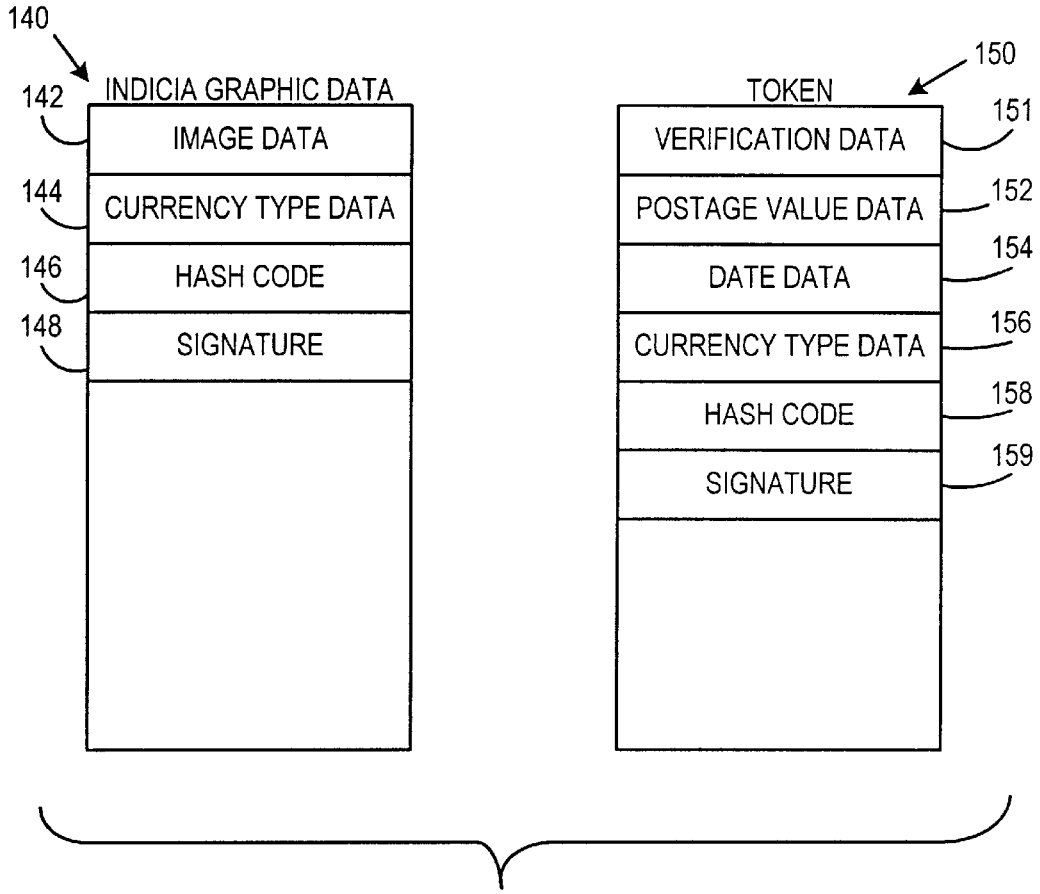
FIG. 4 includes schematic representations of indicia graphic data and a token in accordance with the present invention.

Referring to FIG. 4, in view of FIGS. 1 and 2, schematic representation of an indicia graphic data file 140 and the token 150 are shown. For the sake of this discussion, it is assumed that the indicia graphic data file 140 corresponds to the postal indicia 20 shown in FIG. 2. The indicia graphic data file 140 is stored in the postage meter NVM 126 and includes image data 142, currency type data 144, a hash code 146 and a digital signature 148. The image data 142 is representative of the postal indicia 20 and includes fixed graphic data corresponding to the fixed portion of the postal indicia 20 and format data indicating mapped regions or fields within the postal indicia 20 that define the insertion locations for the variable portion of the postal indicia 20. The currency type data 144 designates a particular currency (US $, CAN $, UK £, F-Franc, D-mark, S-Franc, Lira, Yen, Euro, etc.) corresponding to the image data 142. In this case, United States dollars. The hash code 146 is a value generated from the image data 142 and currency type data 144 using a predetermined hash function algorithm. Generally, hash codes are substantially smaller than the data strings that they are based on. Also, the hash function algorithm is designed in such a way that it is extremely unlikely that two data strings will produce the same hash code. Additionally, the algorithm is further designed so that it is nearly impossible to derive the original data string from the hash code. Any number of different conventional hash function algorithms may be employed to generate the hash code 146. The signature 148 is a value generated from the hash code 146 using a predetermined encryption technique (public key, private key, etc.). Generally, like a written signature, the purpose of a digital signature is to guarantee that the entity sending a message really is who it purports to be. To be effective, digital signatures must be unforgeable. Any number of different conventional encryption techniques may be employed to generate the signature 148. By acting on the hash code 146, the calculations to produce the signature 148 are simplified because the data string is smaller than the amount of data associated with the indicia graphic data 140.

The token 150 is generated by the postage meter 120 in response to a request from the operator to print postage and is transmitted to the printer micro controller 162 for use in formatting the postal indicia 20. The token 150 includes verification data 151, postage value data 152, date data 154, currency type data 156, a hash code 158 and a digital signature 159. Generally, the verification data 151 is printed within the postal indicia 20 and is used by the postal authority to verify the integrity of the postal indicia 20. The postage value data 152 corresponds to the postal value 28 by indicating the amount of postage requested while the date data 154 indicates the current date. The currency type data 156, the hash code 158 and the digital signature 159 are analogous to those discussed above with respect to the indicia graphic data 140.

Figure 5:
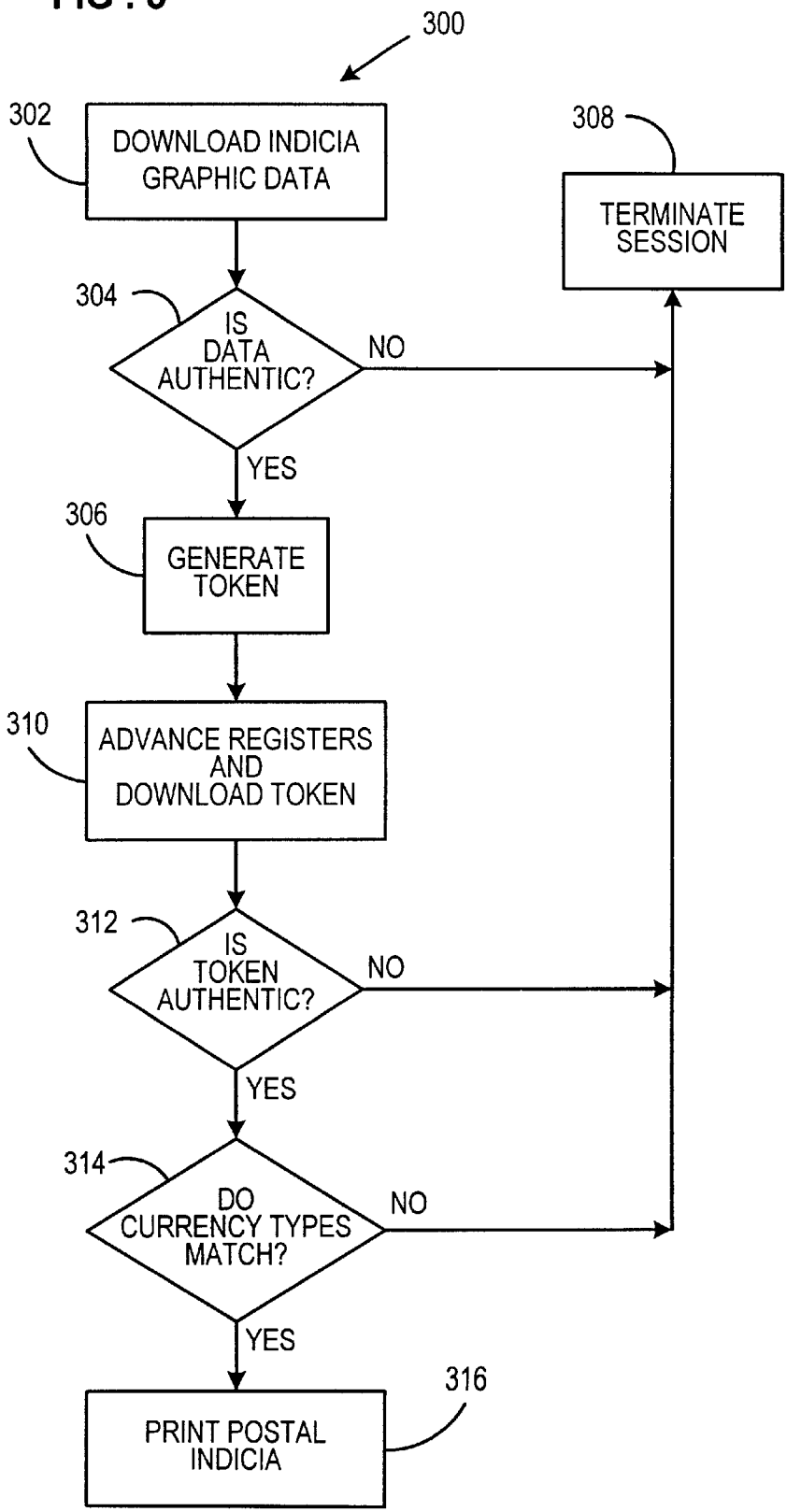
FIG. 5 is a flow chart of a routine for ensuring that the currency type of the token generated by the postage meter matches the currency type of the image graphic data in the printer in accordance with the present invention.

Referring to FIG. 5, in view of the structure of FIGS. 1–4, a routine 300 showing the operation of the postage metering system 100 following a successful system initialization is shown. As described above, during system initialization, the postage meter 120 and the printer 160 seek to mutually authenticate each other in response to a predetermined event, such as: system power up, the beginning of a batch run of mailpieces, after a predetermined number of mailpieces, any other desired event and/or any combination of the above. For the sake of clarity and brevity, it is assumed that mutual authentication has been successful, a session has been established where the postage meter is enabled to dispense postage and the printer is enabled to print postal indicia and the operator has requested the postage metering system 100 to print postage on a mailpiece.

At 302, the postage meter 120 downloads the indicia graphic data 140 to the RAM 164 of the printer 160 in response to a predetermined event. Preferably, the predetermined event is immediately after session initialization. However, the predetermined event may be any combination of convenient events, such as: the beginning of a batch run of mailpieces, after a predetermined number of mailpieces and/or any other desired event. In the most preferred embodiment, downloading of the indicia graphic data 140 is tied to each session initialization. However, the two activities may occur independently.

Next, at 304, the printer 160 makes a determination whether or not the indicia graphic data 140 is authentic (from a trusted source, such as the postage metering system manufacturer or the postal authority) using an encryption technique corresponding to the one employed to generate the signature 148. If the answer is yes, then the routine 300 proceeds to 306. On the other hand, if the answer is no, then, at 308, the session is terminated and the indicia graphic data 140 is deleted from the RAM 164. However, as an alternative to terminating the session and deleting the indicia graphic data 140 from the RAM 164, any activity that has as its effect the prevention of printing the postal indicia 20 may be employed.

At 306, the postage meter 120 generates the token 150 by: (i) assembling the postage value data 152 and/or the date data 154 (as well as any other data, such as: piece count, serial number, etc., that may be defined as variable data); (ii) generating the verification data 151; (iii) reading the currency type data 144; and (iv) generating the hash code 158 (using the verification data 151, postage value data 152, date data 154 and currency type data 156) and the signature 159. Next, at 310, the postage meter 120 advances the registers accordingly in relation to the postage value data 152 and downloads the token 150 to the printer micro controller 162. Next, at 312, the printer 160 makes a determination whether or not the token 150 is authentic using an encryption technique corresponding to the one employed to generate the signature 159. If the answer is yes, then the routine 300 proceeds to 314. On the other hand, if the answer is no, then the routine proceeds to 308.

At 314, the printer 160 makes a determination whether or not the currency type data 144 contained within the indicia graphic data 140 corresponds to the currency type data 156 contained within the token 150. Generally, this may be accomplished by: (i) using the same hash function algorithm in the same manner as was employed to generate the hash code 146 to verify the accuracy of the currency type data 144; (ii) using the same hash function algorithm in the same manner as was employed to generate the hash code 158 to verify the accuracy of the currency type data 156; and (iii) comparing the currency type data 144 with the currency type data 156 to see if they are the same. If the answer is yes, then the routine 300 proceeds to 316 where the postal indicia 20 is printed by the print mechanism 166. On the other hand, if the answer is no, then the routine proceeds to 308.

To print subsequent postal indicia, the routine 300 may return to 302 or may merely return to 306. The determination whether or not to return all the way back to 302 is dependent upon the occurrence of the predetermined event as described above.

Those skilled in the art will now appreciate the present invention prevents a potential attacker from loading an postal indicia image into a printer from first poster meter operating in a first currency (e.g. US $), maintaining the image in memory while removing the first meter and replacing it with a second meter operating in a second currency (e.g. Yen), and printing postal indicias appearing in the first currency while accounting in the second currency.

Those skilled in the art will now also appreciate that the present invention allows the printer to adapt to the currency type of the postage meter. Thus, at those locations having the need to print postage in two currencies, two postage meters may be employed with a single base and printer. A first meter may be employed to print postage in a first currency and a second meter may be employed to print postage in a second currency because the printer is configured accordingly by having the postage meter hold the image graphic data and download it to the printer following session initialization. In this manner, the cost associated with having the printer store a plurality of image graphic data files corresponding to different countries in order to handle different meters is avoided.

It should be understood that the present invention is applicable to other postage metering systems having different configurations. For example, the indicia graphic data may be permanently stored at the printer at the time of manufacture instead of downloaded from the meter. As another example, the postage meter may merely be a smart card while the user interface and other components are resident within the mailing machine base. As yet another example, the exact configuration of the data that constitutes the fixed graphic portion, variable portion, verification data and other parameters is subject to wide design choice and specification by the postal authorities and thus is not a limiting factor to the practice of the present invention.

Many features of the preferred embodiment represent design choices selected to best exploit the inventive concept as implemented in a postage metering system having a postage meter, base and a printer. However, those skilled in the art will recognize that the concepts of the present invention can be applied to other postage metering system configurations that do not include a base, such as where the postage meter is a stand alone unit in operative communication with a printer. As another example, the present invention may be employed in the configuration described in concurrently filed copending U.S. patent application Co./No. 09/294,607 filed Apr. 19, 1999 entitled POSTAGE METERING SYSTEM HAVING SEPARABLE MODULES WITH MULTIPLE CURRENCY CAPABILITY AND SYNCHRONIZATION (E-721), the disclosure of which is specifically incorporated herein by reference. That is, the present invention is applicable to any postage metering system where the postage metering portion is remotely located from the printing portion. In this context, remote may mean adjacent, but not co-located within the same secure structure, or physically spaced apart.

Additionally, although the description above applies a specific encryption technique to verifying the authenticity of the currency type indicators, those skilled in the art will recognize that other techniques may be employed to prevent manipulation of the currency type indicators. For example, the currency type indicators may be disguised by integrating them in a predetermined fashion into the data strings that they are associated with. In this manner, the currency type indicator in not readily discernable because it is disguised with the data string.

Therefore, the inventive concept in its broader aspects is not limited to the specific details of the preferred embodiment but is defined by the appended claims and their equivalents.

What is claimed is:

1. A postage metering system, comprising:

a postage meter including a micro controller for generating token data for use in printing a postal indicia, the token data including an indicator of a token currency type; and a printer in communication with the postage meter, the printer including a micro controller, a memory and a print mechanism for printing the postal indicia on a mailpiece, the memory having stored therein indicia graphic data including an indicator of an indicia graphic currency type; and wherein:

the printer micro controller receives the token data from the postage meter and compares the token data indicator of the token currency type with the indicia graphic data indicator of the indicia graphic currency type prior to printing the postal indicia.

2. The postage metering system of claim 1, wherein:

if the token data indicator of the token currency type does not match the indicia graphic data indicator of the indicia graphic currency type, then the printer micro controller does not print the postal indicia associated with the token data.

3. The postage metering system of claim 2, wherein:

the indicia graphic data is stored in the memory of the printer by the postage meter micro controller in response to a predetermined event.

4. The postage metering system of claim 3, wherein:

the indicia graphic data includes an indicia hash code based on the indicia graphic data indicator of the indicia currency type;

the token data includes a token hash code based on the token data indicator of the token currency type; and the printer micro controller uses the indicia hash code and the token hash code to verify the integrity of the indicia graphic data indicator of the indicia currency type and the token data indicator of the token currency type prior to comparing them.

5. The postage metering system of claim 4, wherein:

the indicia graphic data is stored in the memory of the printer by the postage meter micro controller after establishing a session in response to a successful mutual authentication between the postage meter and the printer; and if the token data indicator of the token currency type does not match the indicia graphic data indicator of the indicia graphic currency type, then the printer micro controller terminates the session.

6. A method of operating a postage metering system including a postage meter and a printer, the printer being in communication with the postage meter and including a print mechanism for printing a postal indicia, the method comprising the step(s) of:

generating token data at the postage meter for use in printing the postal indicia, the token data including an indicator of a token currency type; and receiving the token data at the printer;

retrieving indicia graphic data from the printer, the indicia graphic data including an indicator of an indicia graphic currency type; and comparing the token data indicator of the token currency type with the indicia graphic data indicator of the indicia graphic currency type prior to printing the postal indicia.

7. The method of claim 6, further comprising the step(s) of:

if the token data indicator of the token currency type does not match the indicia graphic data indicator of the indicia graphic currency type, then disabling printing of the postal indicia associated with the token data.

8. The method of claim 7, further comprising the step(s) of:

causing the postage meter to store the indicia graphic data in the printer in response to a predetermined event.

9. The method of claim 8, wherein:

the indicia graphic data includes an indicia hash code based on the indicia graphic data indicator of the indicia currency type; and the token data includes a token hash code based on the token data indicator of the token currency type; and further comprising the step(s) of:

using the indicia hash code and the token hash code to verify the integrity of the indicia graphic data indicator of the indicia currency type and the token data indicator of the token currency type prior to comparing them.

10. The method of claim 9, further comprising the step(s) of:

causing the postage meter to store the indicia graphic data in the printer after establishing a session in response to a successful mutual authentication between the postage meter and the printer; and if the token data indicator of the token currency type does not match the indicia graphic data indicator of the indicia graphic currency type, then terminating the session.

11. A method of manufacturing a postage metering system including a postage meter and a printer, the printer being in communication with the postage meter and including a print mechanism for printing a postal indicia, the method comprising the step(s) of:

supplying the postage meter with capability to generate token data for use in printing the postal indicia, the token data including an indicator of a token currency type; and supplying the printer with capability to receive the token data;

storing indicia graphic data including an indicator of an indicia graphic currency type; and supplying the printer with capability to compare the token data indicator of the token currency type with the indicia graphic data indicator of the indicia graphic currency type prior to printing the postal indicia.

12. The method of claim 11, further comprising the step(s) of:

supplying the printer with capability to disable printing of the postal indicia associated with the token data if the token data indicator of the token currency type does not match the indicia graphic data indicator of the indicia graphic currency type.

13. The method of claim 12, further comprising the step(s) of:

storing the indicia graphic data in the postage meter; and supplying the printer with capability to store the indicia graphic data in the printer in response to a predetermined event.

14. The method of claim 13, wherein:

the indicia graphic data includes an indicia hash code based on the indicia graphic data indicator of the indicia currency type; and the token data includes a token hash code based on the token data indicator of the token currency type; and further comprising the step(s) of:

supplying the printer with capability to use the indicia hash code and the token hash code to verify the integrity of the indicia graphic data indicator of the indicia currency type and the token data indicator of the token currency type prior to comparing them.

15. The method of claim 14, further comprising the step(s) of:

supplying the meter with capability to store the indicia graphic data in the printer after establishing a session in response to a successful mutual authentication between the postage meter and the printer; and supplying the printer with capability to terminate the session if the token data indicator of the token currency type does not match the indicia graphic data indicator of the indicia graphic currency type.

* * * * *